United States Patent [19]

Rutigliano

[11] Patent Number: 4,872,631

[45] Date of Patent: Oct. 10, 1989

[54] DRIP-CAN HOLDER

[76] Inventor: Frank Rutigliano, 16 Poplar St., Centereach, N.Y. 11720

[21] Appl. No.: 258,005

[22] Filed: Oct. 14, 1988

[51] Int. Cl.[4] ..... A47K 1/08

[52] U.S. Cl. ..... 248/313; 99/425; 99/446; 248/316.7

[58] Field of Search ..... 248/313, 311.2, 316.7; 99/444, 446, 425

[56] References Cited

U.S. PATENT DOCUMENTS

| | | | |
|---|---|---|---|
| 1,032,527 | 7/1912 | Bainum | 248/313 |
| 1,646,562 | 10/1927 | Snow | 248/313 |
| 3,212,661 | 10/1965 | Adell | 248/313 |
| 3,369,482 | 2/1968 | Kahn et al. | 99/446 X |
| 3,745,912 | 7/1973 | Field | 99/446 |
| 3,797,375 | 3/1974 | Cerola | 99/446 X |
| 3,959,620 | 5/1976 | Stephen, Jr. | 99/446 X |
| 4,508,024 | 4/1985 | Perkins | 99/446 X |
| 4,784,360 | 11/1988 | Mok | 248/313 |

FOREIGN PATENT DOCUMENTS

| | | | |
|---|---|---|---|
| 2933884 | 3/1981 | Fed. Rep. of Germany | 99/425 |

*Primary Examiner*—Alvin C. Chin-Shue
*Assistant Examiner*—David L. Talbott
*Attorney, Agent, or Firm*—Richard L. Miller

[57] ABSTRACT

This grease collecting drip-can holder is designed to be attached to a bottom wall of a barbecue cooker for holding cans of various sizes to catch grease. Primarily, it consists of a plate with a mounting lip formed therein that can be mounted to a bottom wall of the cooker, and a can supporting lip is also formed therein for engaging with a bottom of a can. A pair of spring clips are also secured to the plate for expansively engaging and holding the can in place.

1 Claim, 1 Drawing Sheet

DRIP-CAN HOLDER

BACKGROUND OF THE INVENTION

The instant invention relates generally to devices for barbecue cookers, and more particularly, to a grease collecting drip-can holder.

Numerous devices have been provided in the prior art that are adapted to aid in barbecue cooking. For example, U.S. patents numbered 4,508,024 of Perkins, 3,959,620 of Stephen, Jr., and 3,785,275 of Keats et al, all are illustrative of such prior art. While these units may be suitable for the particular purpose to which they address, they would not be as suitable for the purpose of the present invention as hereafter described.

SUMMARY OF THE INVENTION

A primary object of the present invention is to provide a grease collecting drip-can holder that will overcome the shortcomings of the prior art devices.

Another object is to provide a grease collecting drip-can holder that will be of such design, as to easily attach to a barbecue cooker and will quickly release a grease collecting drip-can.

An additional object is to provide a grease collecting drip-can holder that will be so designed, as to hold beverage and food cans of different sizes.

A further object is to provide a grease collecting drip-can holder that is simple and easy to use.

A still further object is to provide a grease collecting drip-can holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
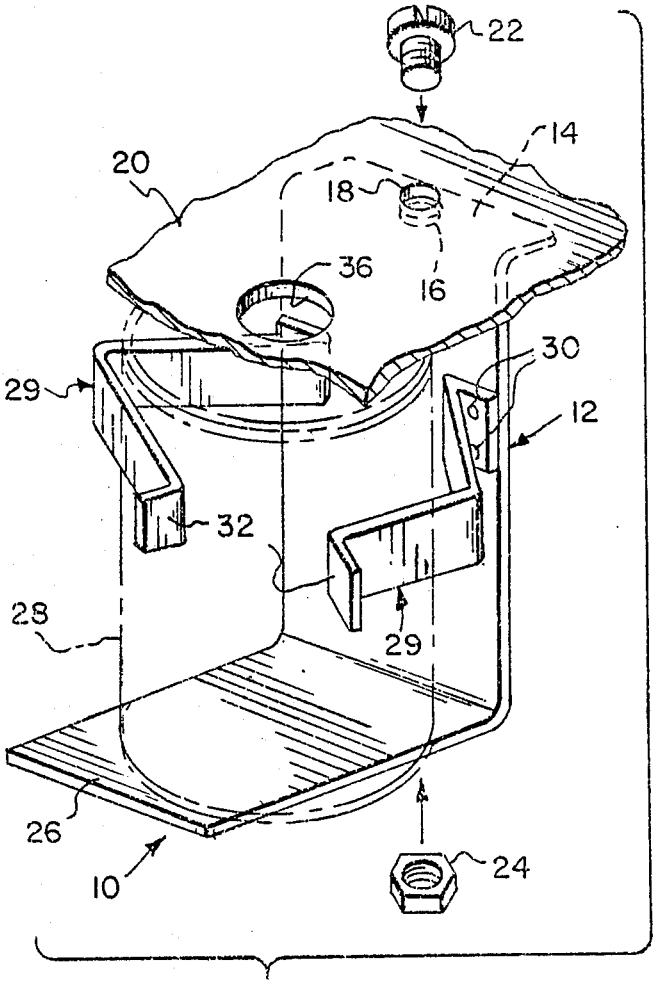
FIG. 1 is a fragmentary partially exploded perspective view showing the instant invention in use holding an empty can.

Turning now descriptively to the drawings, in which like reference characters denote like elements throughout the several views, a holder 10 is shown to include a plate 12 having a mounting lip 14 formed at right angles thereto. A central opening 16 is provided through mounting lip 14 and aligns with a similar opening 18 drilled through bottom wall 20 of a barbecue cooker (not shown). A bolt fastener 22 is received through openings 16 and 18 and a nut fastener 24 is received on bolt fastener 22, for securing holder 10 to the bottom wall 20.

Figure 3:
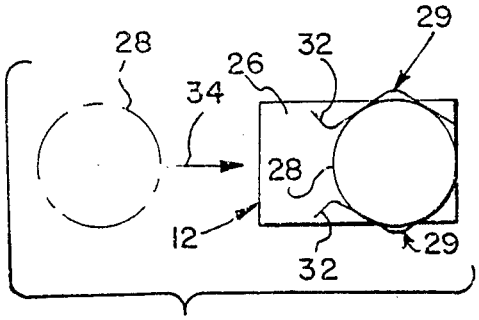
FIGS. 3 & 4 are diagrammatic views illustrating how the instant invention automatically adjusts to different size cans.
Figure 4:
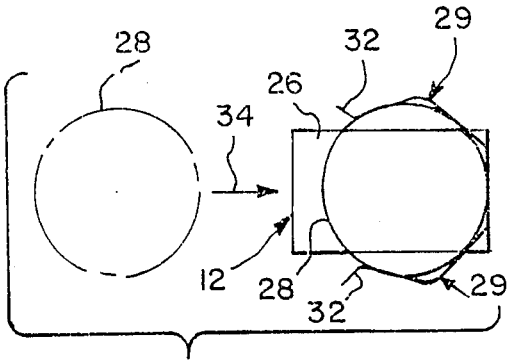
Figure 2:
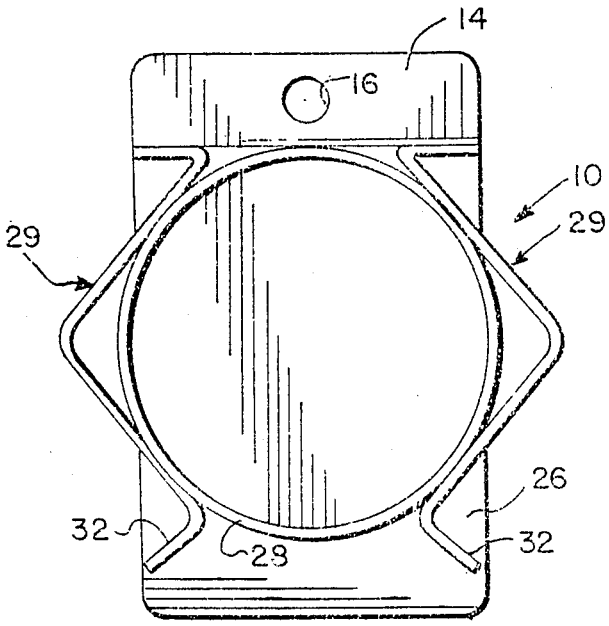
FIG. 2 is a top plan view of the instant invention per se.

A can supporting lip 26 is also formed at right angles in the opposite direction of lip 14, and is designed to support a beverage or food can 28. A pair of spaced apart spring clips 29 are provided and are fixedly secured to a face portion of plate 12 by fasteners 30. Spring clips 29 serve to expansively engage the outer peripheral surface of can 28, so as to hold can 28 in place on the support lip 26, outwardly bent wing portions 32 of spring clips 29, provide for easy spreading apart of the clips 29 when inserting the can 28 as is illustrated by the arrows 34 in FIGS. 3 and 4.

It shall be noted that an opening 36 is illustrated through a bottom wall 20 of the barbecue, as is well known in the art, for the grease drippings to drip through into the can 28, and this design of the device is such, that a barbecue cooker may be moved without a can 28 falling therefrom.

It shall further be recognized that the present invention is such, that it can adapt to current bolt hardware on portable gas barbecues, and it also replaces an awkward device being currently employed and facilitates easy removal and installation of grease collecting drip cans that may vary in size.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A grease collecting receptacle holder for a barbecue cooker, said cooker having a port in the bottom thereof through which grease and other residual materials which collect in said cooker may pass, and an opening proximate to said port in the bottom of said cooker for attaching thereto a holder for a grease collecting can or the like comprising:

(a) a plate formed from a solid material and having a top portion, a bottom portion, and first and second side portions;

(b) a mounting lip extending from the top portion of said plate and substantially perpendicular thereto, said mounting lip having an opening therein adapted for alignment with the opening in the bottom of said cooker whereby said mounting lip may be removably secured to said cooker;

(c) a support lip extending from the bottom portion of said plate and substantially perpendicular thereto in a direction opposite to that of said mounting lip, said support lip being adapted to align with said port and to support thereon a receptacle for receiving and collecting the grease and other materials passing through said port;

(d) first and second substantially V-shaped spring clips fixedly secured respectively to the first and second side portions of said plate and extending horizontally therefrom in the direction of said support lip whereby said spring clips are spaced apart with the open portion of the V of each of said spring clips facing the open portion of the V of the other said clip, each of said spring clips having a short wing portion extending angularly outwardly from each end thereof forming two additional angular extensions in each of said spring clips, the said wing portions at the inside end of each said spring clip being adapted to be secured to said plate, and the wing portions at the outside end of said spring clip being adapted to provide at their junctions with the body of each spring clip a cam means for spreading said first and second spring clips apart when a receptacle is inserted between said spring clips, the open portion of the V of each of said spring clips being adapted to securely hold said receptacle.

* * * * *